US010843841B2

(12) United States Patent
Kohn et al.

(10) Patent No.: US 10,843,841 B2
(45) Date of Patent: Nov. 24, 2020

(54) DEVICE FOR MOVING AND STORING POTTED PLANTS AND OTHER OBJECTS HAVING A BASE

(71) Applicants: Steve Kohn, Short Hills, NJ (US); Amy Rigazio, Farmingdale, NJ (US)

(72) Inventors: Steve Kohn, Short Hills, NJ (US); Amy Rigazio, Farmingdale, NJ (US)

(73) Assignee: BROADWAY HOLDINGS IV, LLC, Monroe, NJ (US)

( * ) Notice: Subject to any disclaimer, the term of this patent is extended or adjusted under 35 U.S.C. 154(b) by 0 days.

(21) Appl. No.: 15/391,787

(22) Filed: Dec. 27, 2016

(65) Prior Publication Data

US 2018/0178948 A1 Jun. 28, 2018

(51) Int. Cl.

*B65D 5/50* (2006.01)
*B65D 85/52* (2006.01)
*B65D 5/49* (2006.01)

(52) U.S. Cl.

CPC ..... *B65D 5/48026* (2013.01); *B65D 5/5038* (2013.01); *B65D 85/52* (2013.01)

(58) Field of Classification Search

CPC ... A01G 9/02; B65D 5/12; B65D 5/50; B65D 5/503; B65D 5/52; B65D 25/04; B65D 25/108; B65D 25/10; B65D 5/48; B65D 5/48026; B65D 5/5038; B65D 85/52

USPC ..... 47/73–78, 83–87; 206/423, 763, 765, 206/486; 229/122.23, 122.29, 122.31

See application file for complete search history.

(56) References Cited

U.S. PATENT DOCUMENTS 1,156,444 A * 10/1915 Stevens ..... B65D 5/12 229/122.29
2,623,682 A * 12/1952 Candell ..... B65D 5/5038 229/104
2,899,051 A * 8/1959 Barnby ..... B65D 71/38 229/122.23
4,621,733 A * 11/1986 Harris ..... B65D 85/52 206/423
5,186,319 A * 2/1993 Ting ..... B65D 5/50 206/763
5,217,117 A * 6/1993 Tsuji ..... B65D 85/505 206/423
5,235,782 A 8/1993 Landaw
5,315,785 A 5/1994 Avot et al.
5,454,213 A 10/1995 Gola
5,685,438 A * 11/1997 Emanuel ..... A47F 7/0028 206/486
5,832,660 A 11/1998 Posa
6,006,500 A 12/1999 Craig et al.
6,095,649 A 8/2000 Brooks et al.
6,189,295 B1 2/2001 Craig et al.
6,546,699 B2 4/2003 Craig et al.

(Continued)

FOREIGN PATENT DOCUMENTS

DE 4105973 A1 * 8/1992 ..... B65D 5/5028
DE 4131727 A1 * 4/1993 ..... B65D 5/50

(Continued)

*Primary Examiner* — Bryon P Gehman

(74) *Attorney, Agent, or Firm* — Philip M. Weiss; Weiss & Weiss

(57) ABSTRACT

A device for securely transporting multiple potted plants or other objects having a base, wherein the device comprises a foundation having several adjustable openings that allow the base of a plant holder or other object to sit securely within the device.

4 Claims, 10 Drawing Sheets

(56) References Cited

U.S. PATENT DOCUMENTS

| | | | | |
|---|---|---|---|---|
| 6,546,700 | B2 | 4/2003 | Craig et al. | |
| 6,691,445 | B2 | 2/2004 | Williams | |
| 6,871,479 | B2 | 3/2005 | Craig et al. | |
| 7,080,483 | B2 | 7/2006 | Craig et al. | |
| 8,853,601 | B2 * | 10/2014 | Noyelle | B65D 5/5038 219/731 |
| 9,731,860 | B2 * | 8/2017 | Kretz | B65D 5/503 |
| 2005/0085365 | A1 | 4/2005 | Tchira | |
| 2008/0257942 | A1 * | 10/2008 | LeBras | B65D 71/38 206/763 |
| 2010/0059580 | A1 * | 3/2010 | Voigt | B65D 5/5038 229/120.02 |
| 2016/0137328 | A1 | 5/2016 | Paynter | |

FOREIGN PATENT DOCUMENTS

| | | | | |
|---|---|---|---|---|
| FR | 2278244 | A1 * | 2/1976 | A01G 9/028 |
| GB | 519405 | A * | 3/1940 | B65D 5/503 |
| JP | 201230828 | A * | 2/2012 | B65D 5/12 |

* cited by examiner

DEVICE FOR MOVING AND STORING POTTED PLANTS AND OTHER OBJECTS HAVING A BASE

FIELD OF THE INVENTION

The present invention relates to a device for moving and storing potted plants and other objects having a base.

BACKGROUND OF THE INVENTION

U.S. Pat. Nos. 6,691,495, 6,546,700, 6,546,699 relate to a modular system for packaging articles for shipment. A potted plant is placed in a cover, then automatically deposited into a protective sleeve. The potted plant thus packaged is ready for containment within a shipping carton.

U.S. Pat. Nos. 6,189,295, 6,006,500 relate to a modular system for packaging articles for shipment. A potted plant is sorted according to a grade, placed in a decorative cover, then automatically deposited into a protective sleeve. The potted plant thus packaged is ready for containment within a shipping carton.

U.S. Pat. No. 6,871,479 relates to a modular system for packaging articles for shipment. A potted plant is placed in a cover, then automatically deposited into a protective sleeve. The potted plant thus packaged is ready for containment within a shipping carton.

U.S. Pat. No. 7,080,483 relates to a modular system for packaging articles for shipment. A potted plant is automatically deposited into a protective sleeve. The potted plant thus packaged is ready for containment within a shipping carton.

U.S. Pat. No. 5,095,649 relates to an assembly for storage of floral items which includes a housing made up of stepped sidewalls, a rear wall, a front wall section at each step and top wall sections at each step. At least one container is located at each step. The containers define at least one water drain opening associated with a water drain system. A cut item separator support may be provided within the containers for dividing the inside of the containers into a plurality of compartments for receipt of floral items therein and for water free transfer of foliage from one container to another.

U.S. Pat. No. 5,832,660 relates to a protective plant covering comprising a sheet of flexible material having two opposing side edges each with a plurality of fasteners such that with the material wrapped around the plant, the two side edges may be brought proximate to one another and adjustably fastened around the plant using the fasteners.

U.S. Pat. No. 5,235,782 relates to a cover for potted plants wherein the cover provides a water tight seal at its base while at the same time protecting the plant from water leaking out of the plant. The cover is a form of a flat, tear away bag that customers of florists and plant nurseries can use themselves without assistance.

U.S. Pat. No. 5,315,785 relates to a wrapping for plants or flowers placed in a pot like container made from a resilient material of natural rigidity and consisting of a frustoconical tubular element open at both ends, the terminal portion at the tube end of small diameter having a retaining stop shoulder extending along at least part of the circumference of the tubular element and defining a free internal opening which is smaller than that of an adjacent portion disposed in the direction of the tube end having a smaller diameter, which stop shoulder is formed by a local cut in the tubular element disposed in a plane substantially perpendicular to the central axis of the tubular element.

U.S. Pat. No. 5,454,213 relates to a method and apparatus for packing horticultural items like cut flowers and potted plants for shipment in cardboard cartons. An elongated rod extends from the top of the carton into a vase holding the horticultural items and secures the vase and horticultural items from movement inside of the carton.

U.S. Patent Publication No. 2005/0085365 relates to a system and method for creating folded flower wraps that use a plurality of molds to define one or more lines in a sheet of material for folding to produce a floral wrap by sequentially placing each one of the plurality of molds in contact with the sheet of material and folding the sheet of material across each one or more of the edges of the molds, the sheet of material is moved from the first position through a plurality of intermediate partially folded positions to the second fully folded position. The second fully folded position corresponds to the desired folded flower wrap.

U.S. Patent Publication No. 2016/0137328 relates to an automated high through-put system and method for shrink wrapping potted plants for packaging and shipping. The system provides the ability to shrink wrap plants by utilizing a conveyer system and heating area with heating units having adjustable, directional nozzle heads.

SUMMARY OF THE INVENTION

The present invention relates to a device for securely transporting multiple potted plants within a single device The present invention relates to multiple objects having a base which can each securely fit within an opening in a device and be held within the opening in the device during storage and transport and allow transport of the multiple objects safely.

The device comprises a foundation having several openings that allow the container base of a plant holder or other objects having a base to sit securely within the device.

It is an object of the present invention for the other objects to comprise a lamp or vase.

It is an object of the present invention for the device to comprise cardboard, paperboard or another fiber based material.

It is an object of the present invention for the device to comprise plastic, or polyethylene material.

It is an object of the present invention for the openings to allow different size container bases of plant holders or other objects to sit securely within the device.

It is an object of the present invention for the openings to allow different shaped container bases of plant holders or other objects to sit securely within the device.

It is an object of the present invention for the device to securely fit within a box or container so that the box or container can be easily moved and stored.

It is an object of the present invention for the plant or body of the object to fit securely within the box or container and for a portion of the plant or body of the object to fit above the device.

It is an object of the present invention for the device to be water-proof.

It is an object of the present invention for the device to be used multiple times.

It is an object of the present invention for the device to be easily cleaned of dirt or other material from the plant holders.

It is an object of the present invention for the openings to have slits within it that can change size to hold different size container bases for the plant holders or other objects having a base.

It is an object of the present invention for the openings to have slits within it that can change size to hold different shaped container bases for the plant holders and other objects having a base.

It is an object of the present invention for the device to fit snuggly within the box or container so that there is little or no movement of the device within the box or container so that the plants or other objects are not harmed during movement of the box or container.

It is an object of the present invention for the device to be made of a foldable material to assist with the device fitting property within a box or container.

It is an object of the present invention for the device to further comprise a divider which is inserted into the box or container above the foundation that separates the different plants or other objects from each other.

It is an object of the present invention for the device to have adjustable sides so that the device fits multiple sizes of boxes or containers.

It is an object of the present invention to place a water repellent or waterproof sheet made from a material such as polyethylene underneath the device along the bottom of the box or container to protect the box or container from any water or dirt spillage from the plant holders.

It is an object of the present invention to attach a water repellant or waterproof sheet made from a material such as polyethylene to the box or container by way of a mechanism such as adhesive tape, clips or another device for attachment.

The present invention relates to a single device for securely transporting multiple potted plants or other objects having a base. The device comprises a foundation having several openings that allow the base of a plant holder or other objects having a base to sit securely within the device. The foundation has slots within it that panels fit within. There are either two or four panels that then are attached to the foundation to hold the foundation above the bottom of the box or container. It is an object of the present invention for the panels to be made of different heights depending on the objects to be placed in the device.

DETAILED DESCRIPTION OF THE INVENTION

Figure 1:
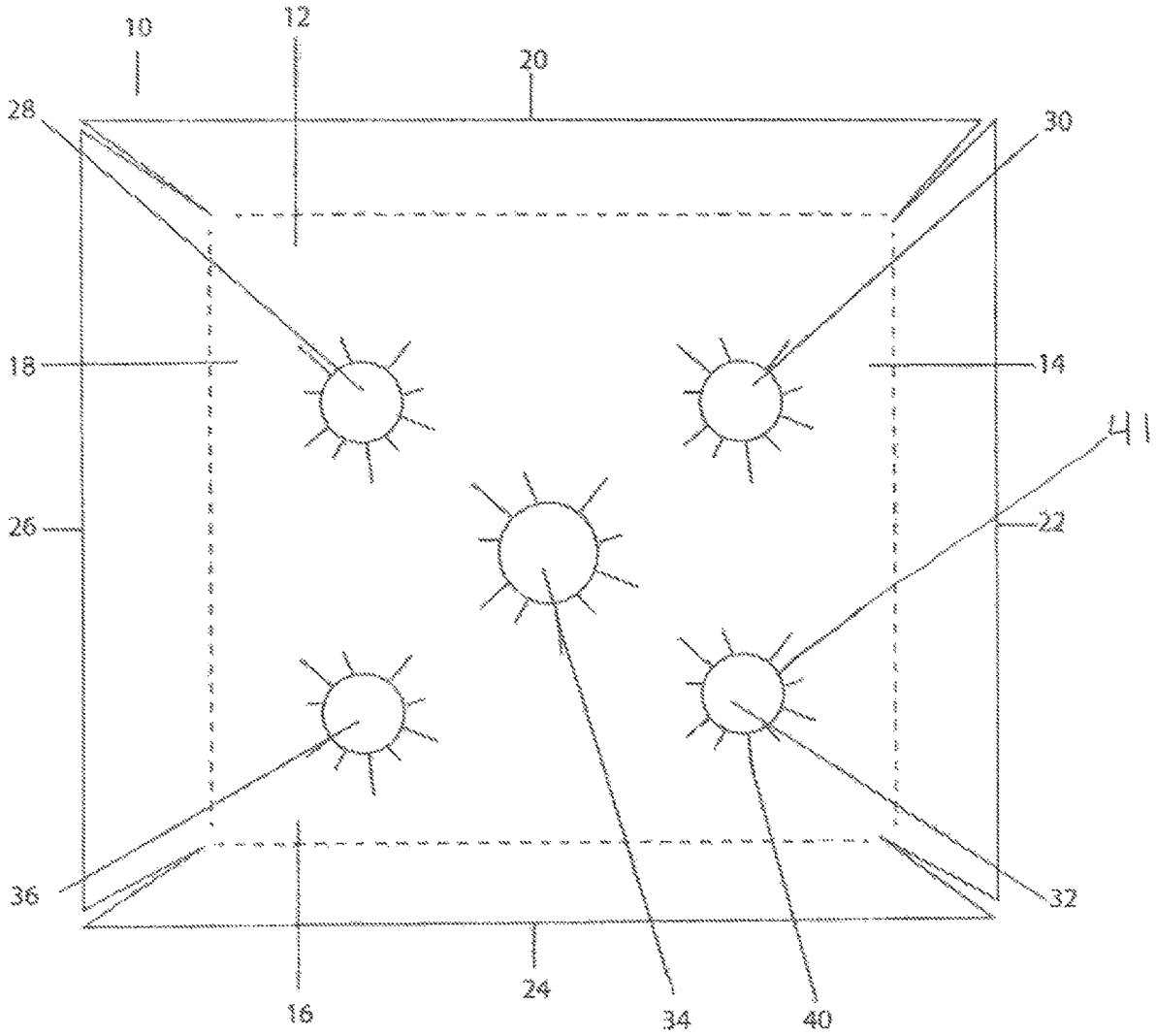
FIG. 1 is a top view of an embodiment of the device of the present invention.

FIG. 1 shows a top view of the device 10 having four sides, 12, 14, 16 and 18. Each of the sides has a foldable portion 20, 22, 24 and 26 respectfully. The device 10 is shown having five openings 28, 30, 32, 34, and 36, however any amount of openings can be placed on the device 10 so long as there 8 enough space for the plants or other objects to fit within the device and in a box or container. Each of the openings has multiple slits 40 between tabs 41 which allow the device to retain different size plant holders or other objects having a base.

Figure 2:
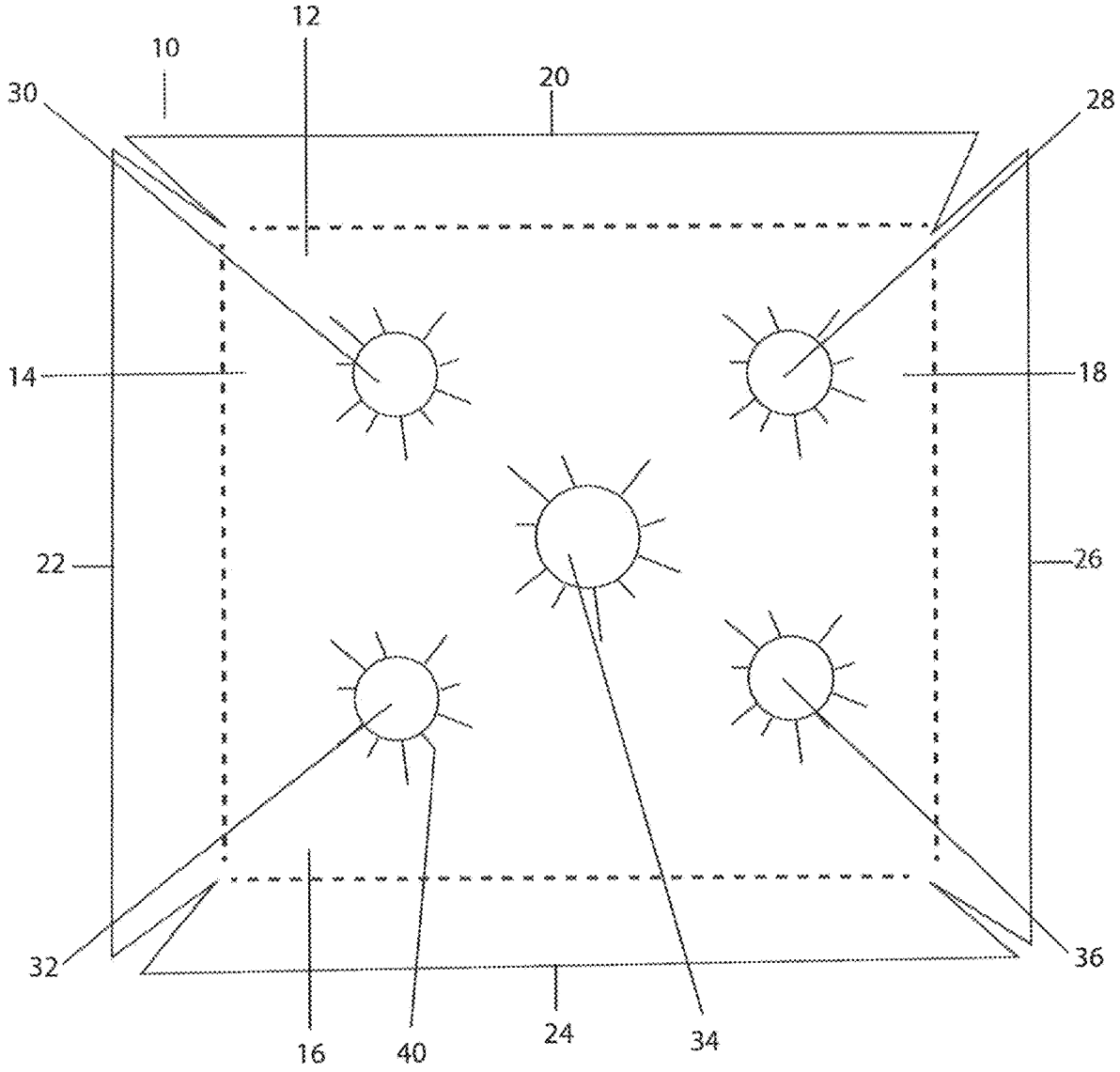
FIG. 2 is a bottom view of an embodiment of the device of the present invention.

FIG. 2 shows a bottom view of the device 10 having four sides, 12, 14, 16 and 18. Each of the sides has a foldable portion 20, 22, 24 and 26 respectfully. The device 10 is shown having five openings 28, 30, 32, 34, and 36, however any amount of openings can be placed on the device 10 so long as there is enough space for the plants or other objects to fit within the device and in the box or container. Each of the openings has multiple slits 40 which allow the device to retain different size plant holders or other objects having a base.

Figure 3:
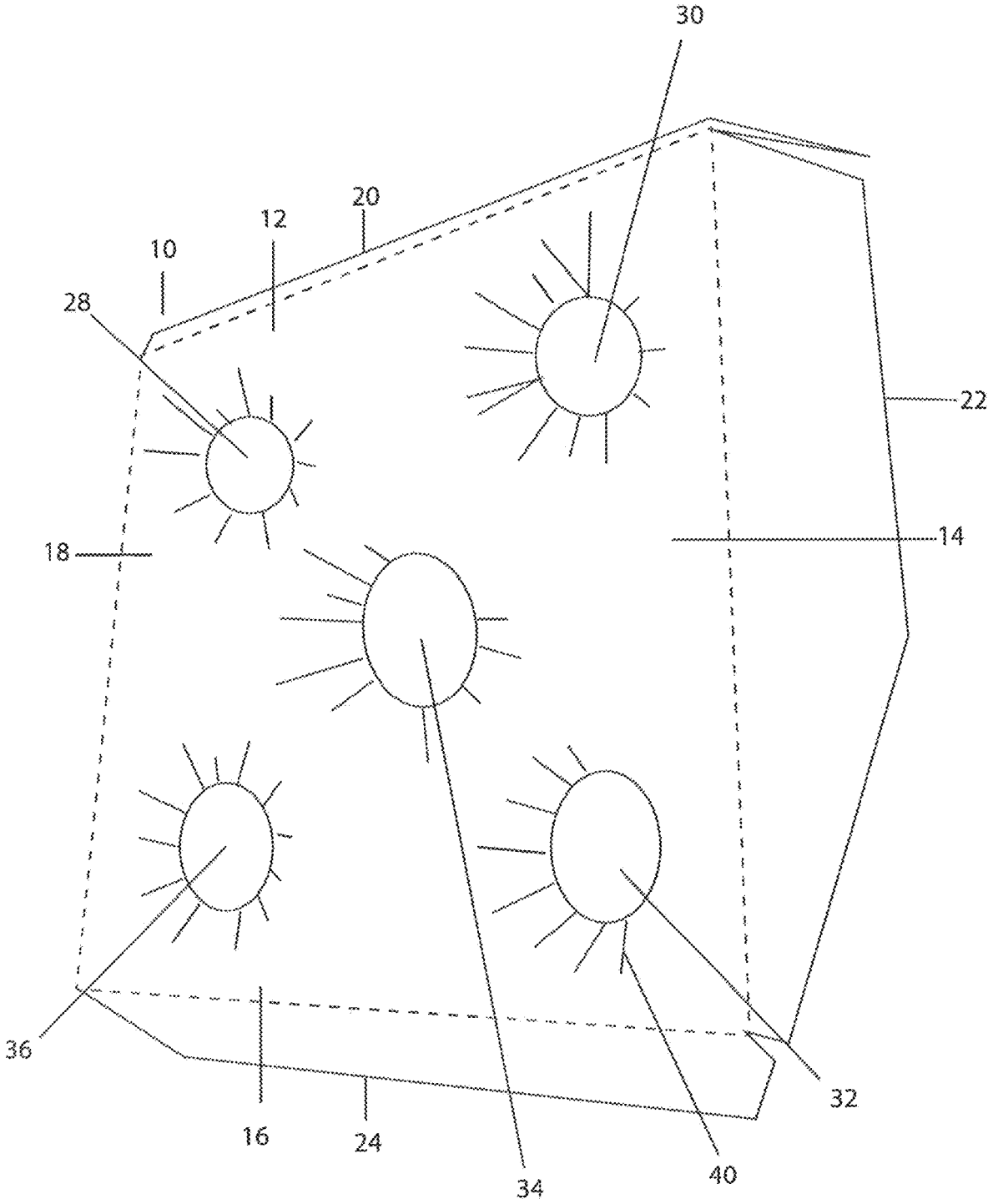
FIG. 3 is a top folded view of an embodiment of the device of the present invention.

FIG. 3 shows a top view of the folded device 10 having sides 12, 14, 16 and 18. Each of the sides has a foldable portion 22, 24 (shown) and 20, 26, (not shown). The device 10 has five openings 28, 30, 32, 34 and 36. Each of the openings has multiple slits 40 which allows the device to retain different size plant holders or other objects having a base.

Figure 4:
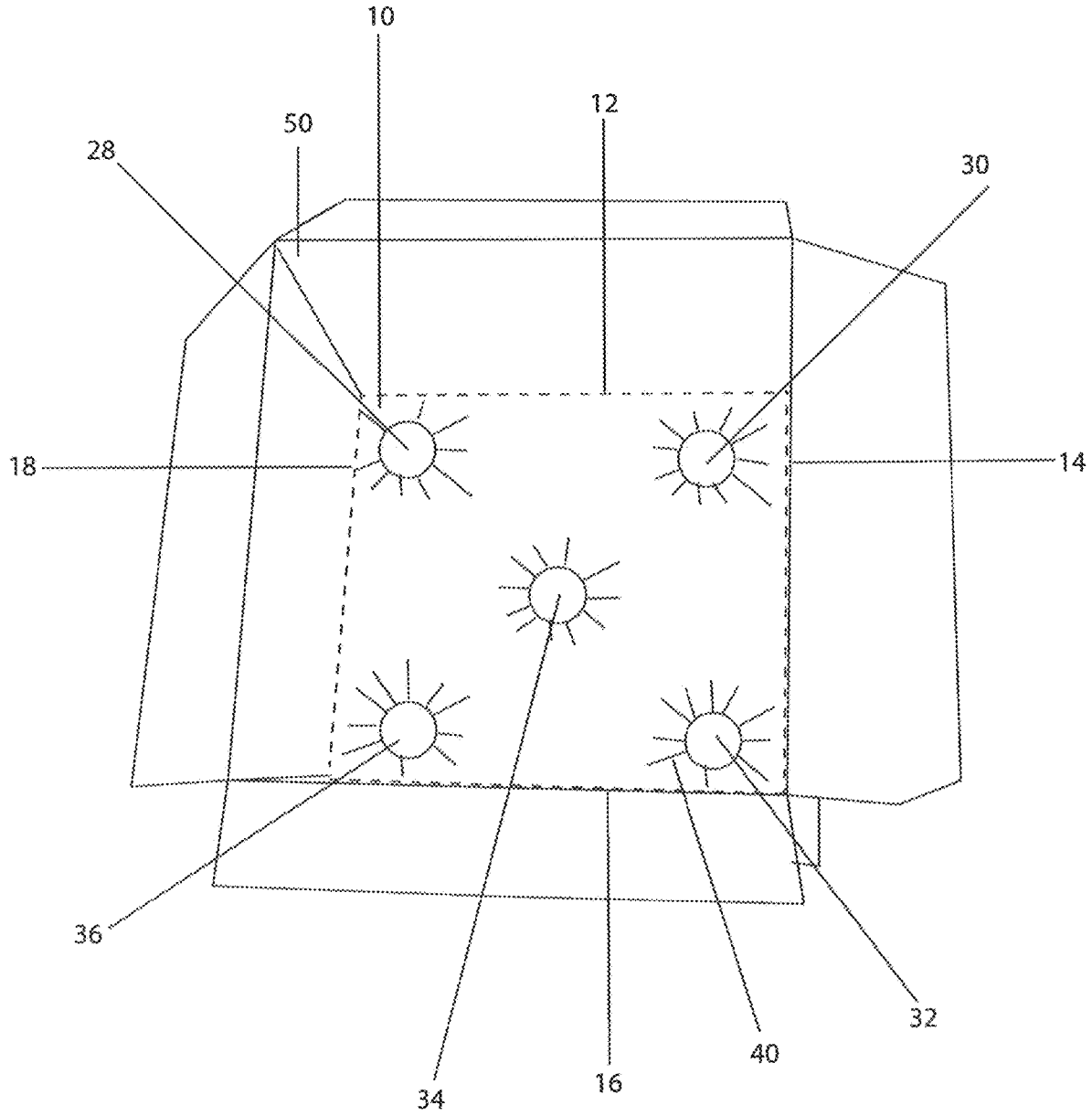
FIG. 4 is a top view of an embodiment of the device of the present invention placed in a box.

FIG. 4 shows the device 10 sitting within a box 50. The foldable portions 20, 22, 24 and 26 (not shown) of sides 12, 14, 16 and 18 fold against the sides of the box 50. The device 10 has five openings 28, 30, 32, 34 and 36. Each of the openings has multiple slits 40 which allows the device to retain different sized and shaped plant holders or other objects having a base.

Figure 5:
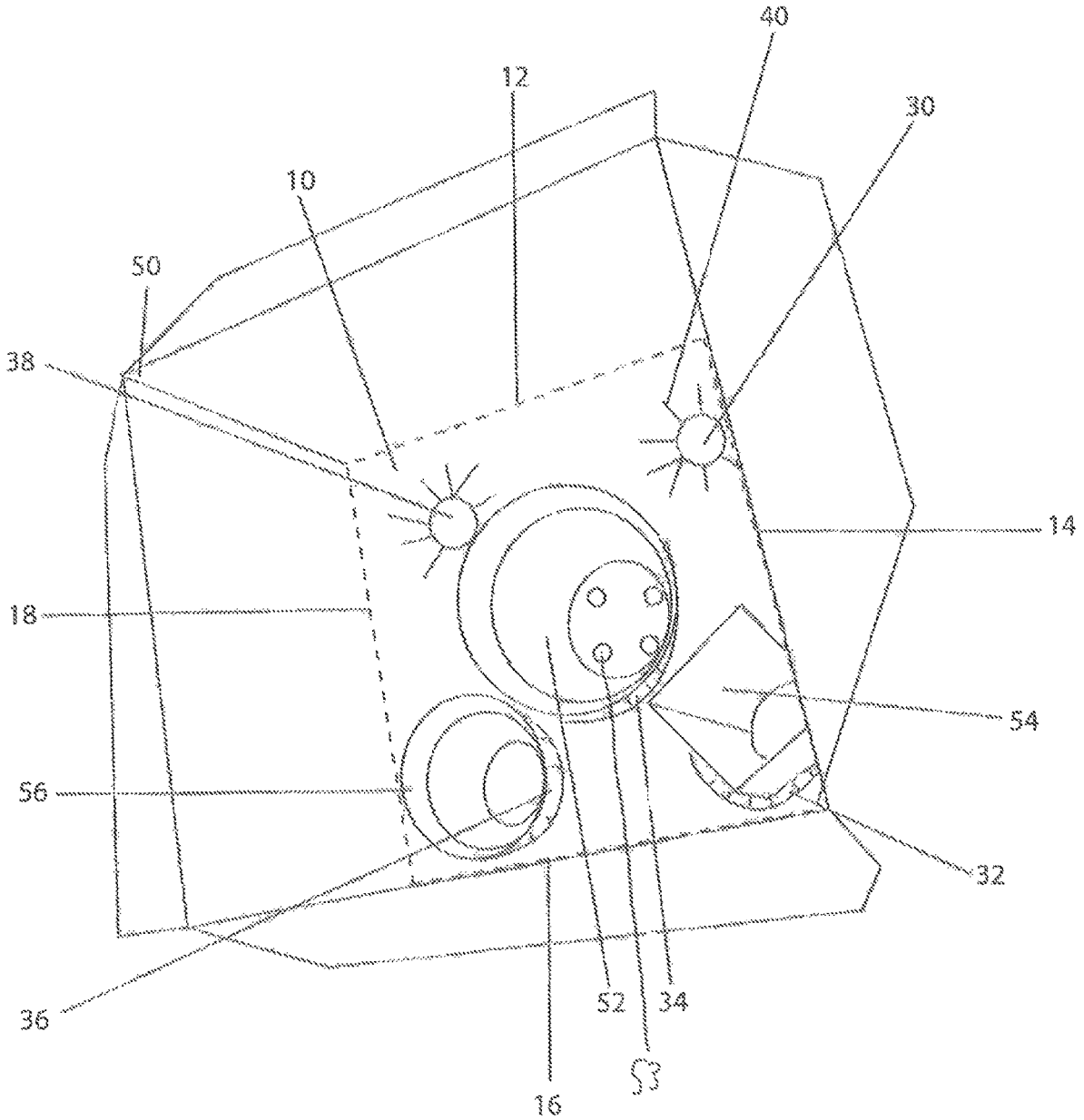
FIG. 5 is a top view of an embodiment of the device of the present invention placed in a box with pots inserted in the device.

FIG. 5 shows the device 10 inserted into a box 50. Plant holder 56 is inserted in opening 36, plant holder 54 is inserted into opening 32 and plant holder 52 is inserted into opening 34. The plant holders 56, 52 and 54 are of different sizes and different shapes.

Figure 6:
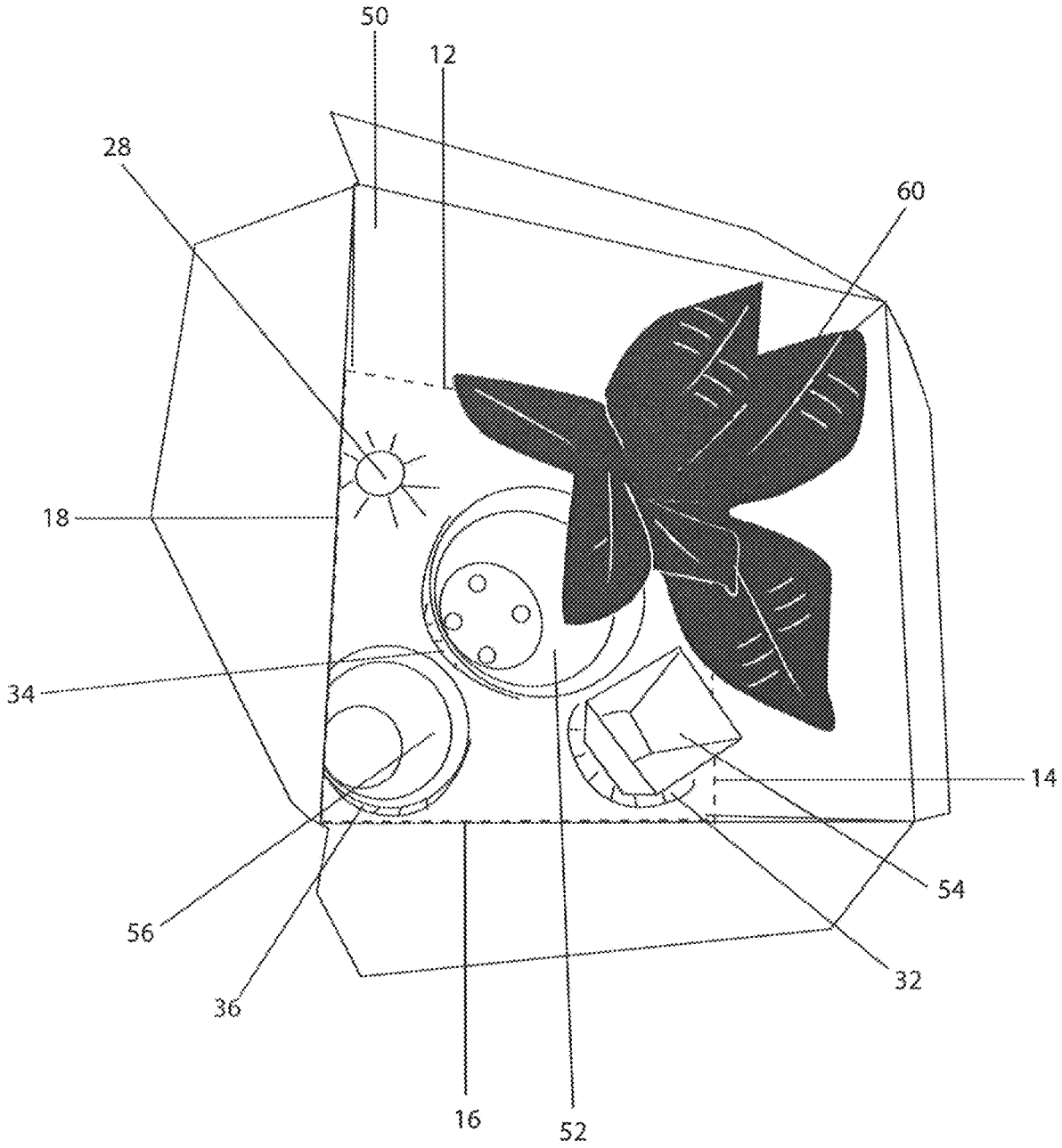
FIG. 6 is a top view of an embodiment of the device of the present invention placed in a box with plant holders and plant holders having plants inserted in the device.

FIG. 6 shows the device 10 within box 50. Plant holders 56, 52 and 54 are placed in openings 36, 34 and 32 respectively. Plant 60 is in a plant holder within opening 30 which is not shown.

Figure 7:
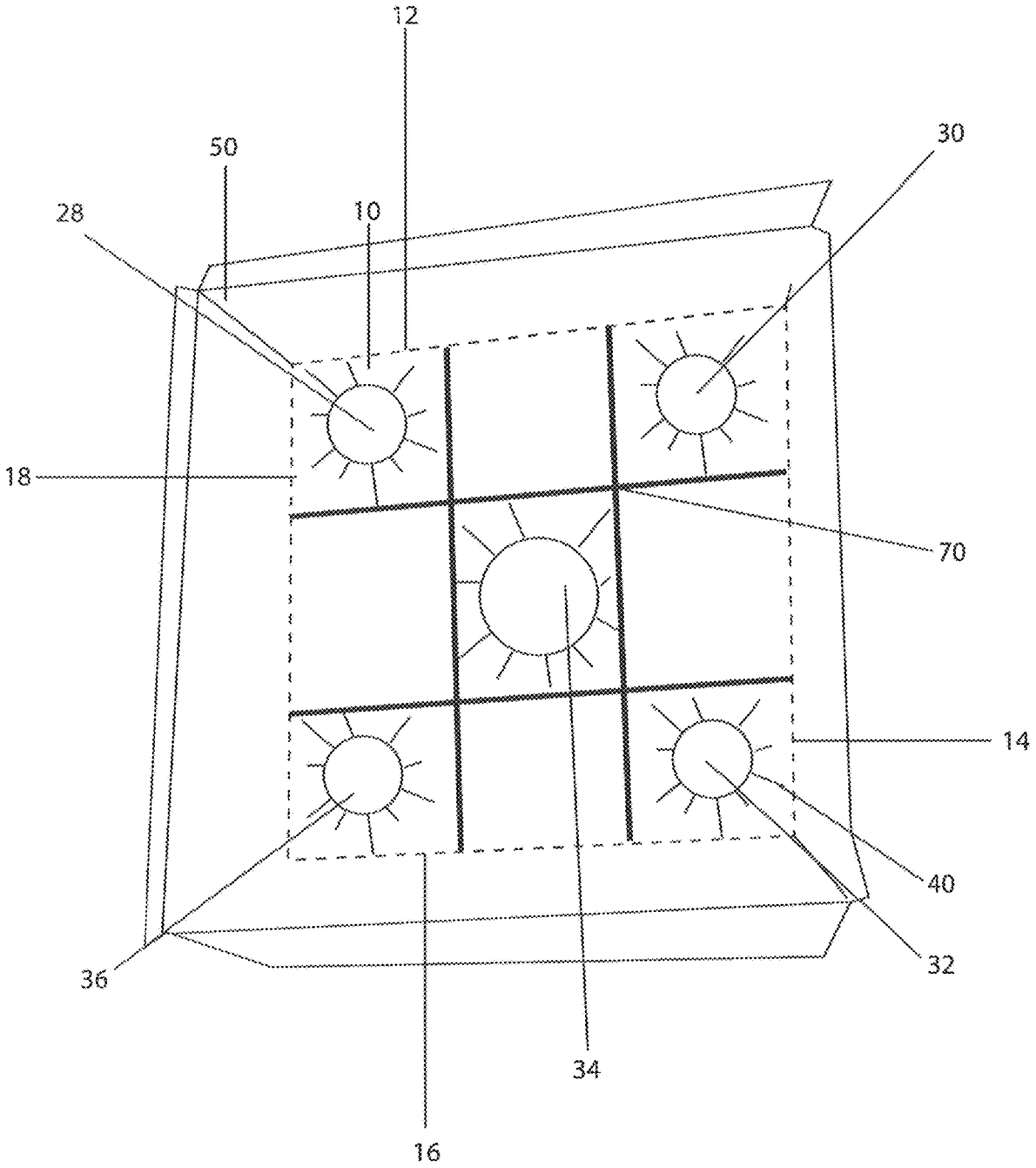
FIG. 7 is a top view of an embodiment of the device of the present invention placed in a box.

FIG. 7 shows the device 10 sitting within a box 50. The foldable portions 20, 22, 24 and 26 (not shown) of sides 12, 14, 16 and 18 fold against the sides of the box 50. The device 10 has five openings 28, 30, 32, 34 and 36. Each of the openings has multiple silts 40 which allows the device to retain different sized and shaped plant holders and other objects having a base. The box 50 further contains divider 70 which provides separation between the different plants and other objects that are placed in the openings. Plant holder 52 touches the bottom of the container 53.

Figure 8:
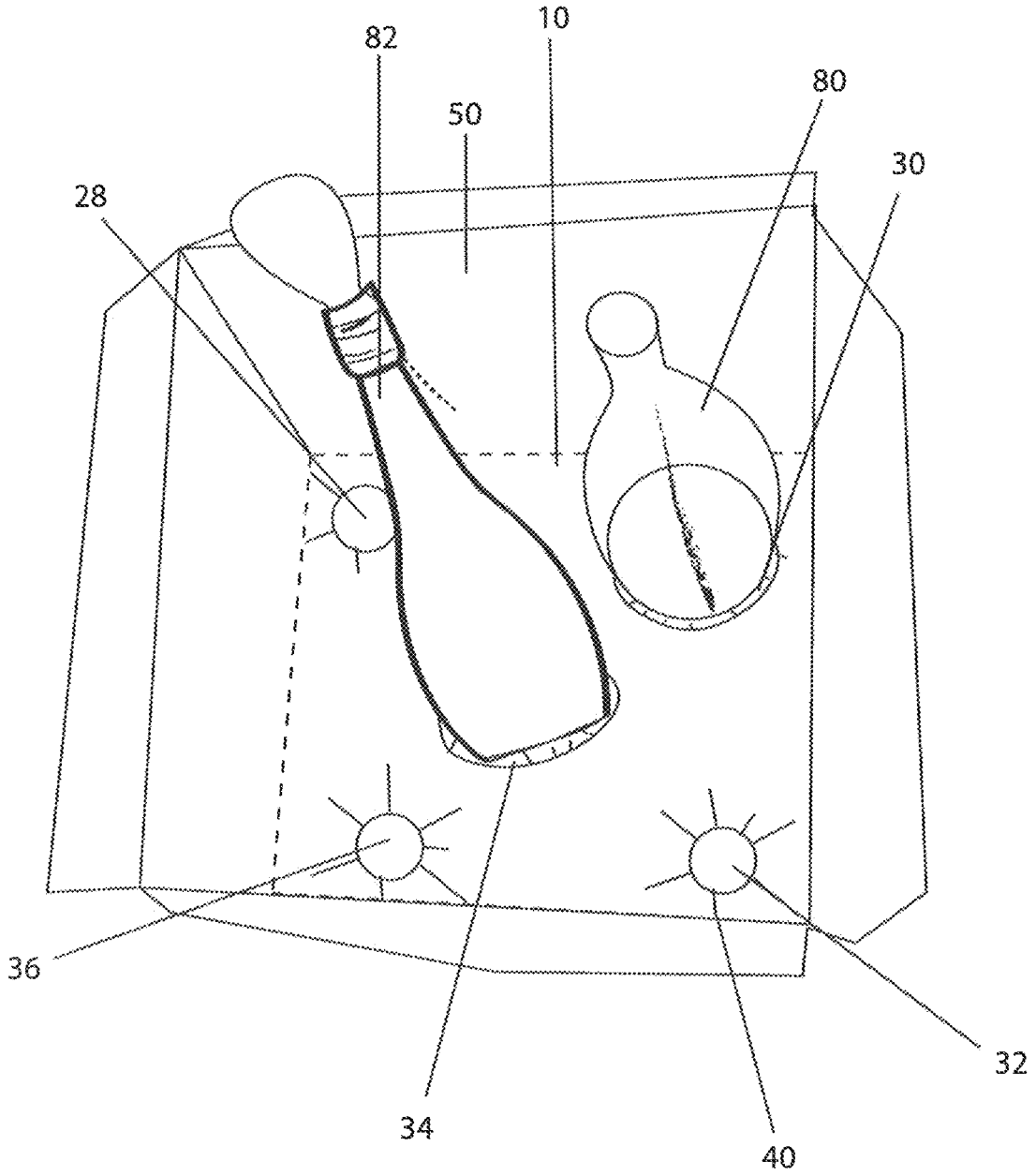
FIG. 8 is a top view of an embodiment of the device of the present invention placed in a box with a vase and lamp inserted in the device.

FIG. 8 shows the device 10 sitting within a box 50. The device 10 has five openings 28, 30, 32, 34 and 36. Each of the openings has multiple silts 40 which allows the device 10 to retain different sized and shaped plant holders and other objects having a base. A vase 80 is placed in opening 30. A lamp 82 is placed in opening 34.

Figure 9:
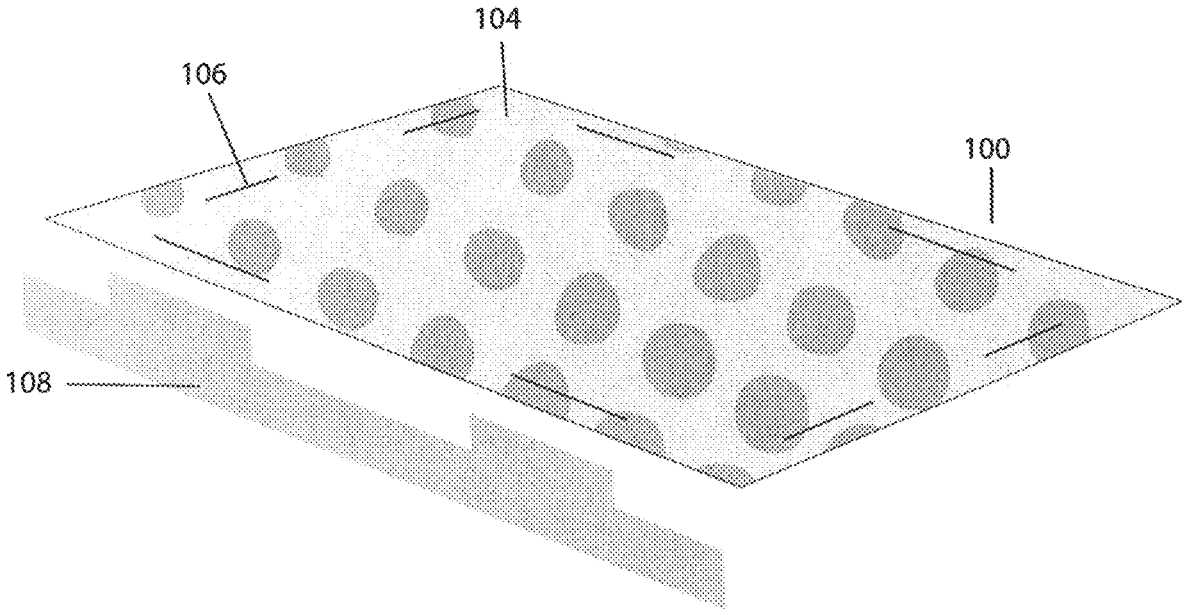
FIG. 9 is a side view of an embodiment of the device of the present invention.

FIG. 9 shows the device 100. The device 100 has a foundation 104 which has slots 106 where the panels 108 fits in to support the device 100.

Figure 10:
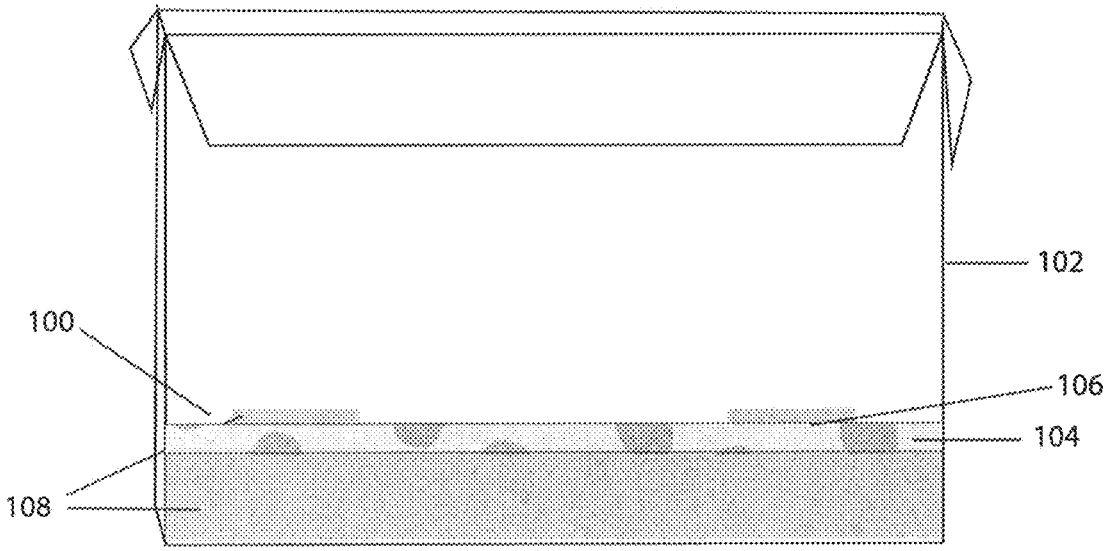
FIG. 10 is a side view through the box of an embodiment of the device of the present invention placed in a box.

FIG. 10 shows the device 100 being in a box 102, the device 100 having a foundation 104 having slots 106. The device 100 has panels 108 placed through the slots 106 to support the device 100.

Figure 11:
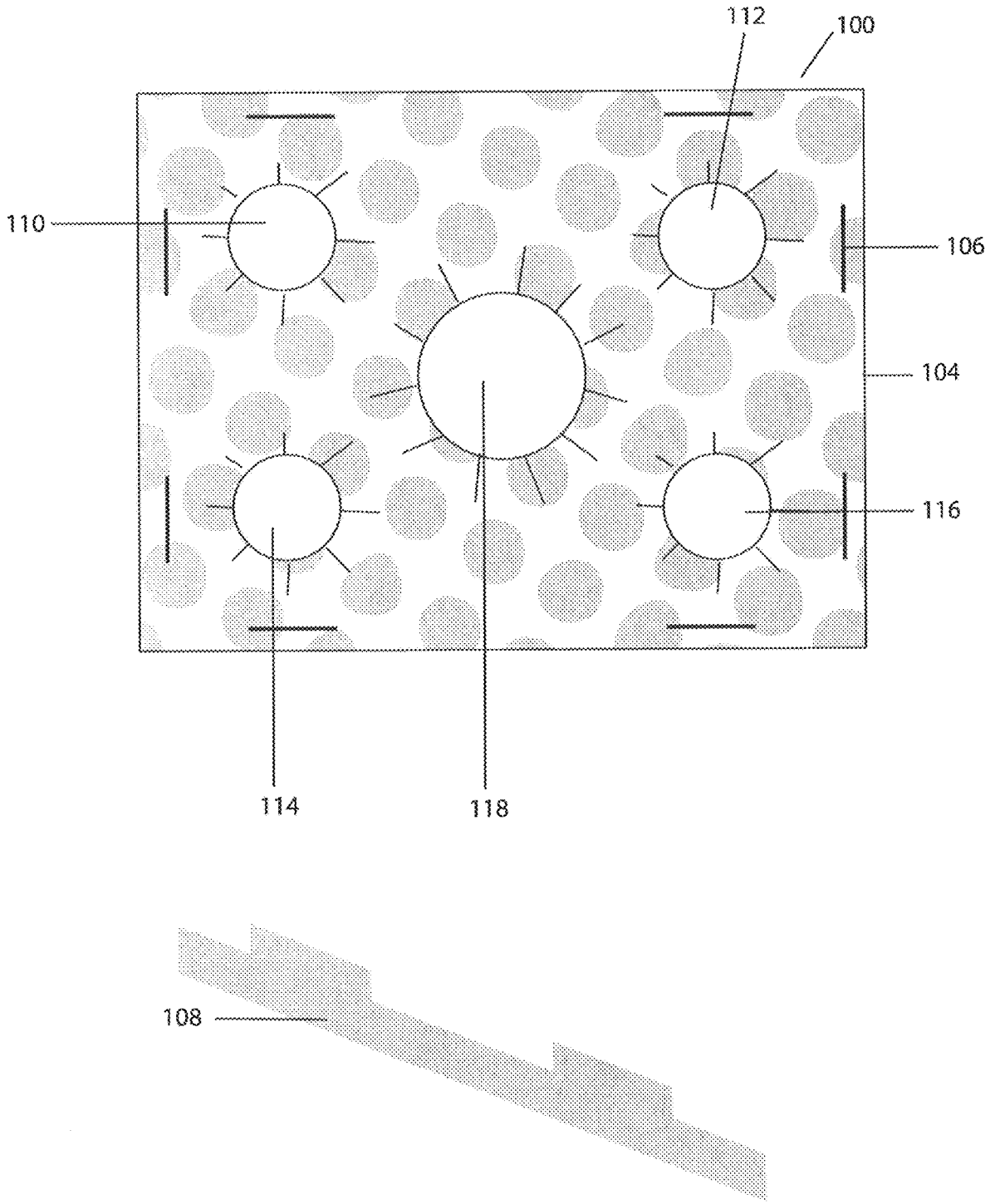
FIG. 11 is a top view of an embodiment of the device of the present invention.

FIG. 11 shows the device 100 having a foundation 104. The foundation 104 has slots 106 that is where the panels 108 are placed through. The foundation 104 has openings 110, 112, 114, 116 and 118.

The invention claimed is:

1. A device for securely transporting multiple objects, each object having a base, said device comprising;

a foundation;

said foundation having four sides;

said foundation having slots within said foundation;

panels separate from said foundation fitting into said slots from beneath said foundation that support said foundation at different elevations above a surface where each of said panels rest;

said foundation comprising several openings;

each of said openings being adjustable so that an object having a base when placed in an opening sits securely within said opening of said openings;

each of said openings comprised of a fixed hole surrounded by multiple adjustable slits between tabs within said foundation, when said tabs are depressed said fixed hole increases in size.

2. The device of claim 1 wherein said panels consist of two panels used to support said foundation.

3. The device of claim 1 wherein said panels consist of four panels used to support said foundation.

4. The device of claim 1 wherein said panels being of different heights to support said foundation at different elevations above said surface.

* * * * *